United States Patent [19]

Nagata et al.

[11] Patent Number: 5,064,026

[45] Date of Patent: Nov. 12, 1991

[54] ELEVATOR MONITOR APPARATUS

[75] Inventors: Yasuhiro Nagata, Inazawa; Toshiaki Kawahara, Tokyo, both of Japan

[73] Assignee: Mitsubishi Denki Kabushiki Kaisha, Japan

[21] Appl. No.: 536,717

[22] Filed: Jun. 12, 1990

[30] Foreign Application Priority Data

Jun. 13, 1989 [JP] Japan ..... 1-150232

[51] Int. Cl.[5] ..... B66B 3/00

[52] U.S. Cl. ..... 187/130

[58] Field of Search ..... 187/111, 130, 133; 340/409, 825.17, 506, 518

[56] References Cited

U.S. PATENT DOCUMENTS

| | | | |
|---|---|---|---|
| 3,916,405 | 10/1975 | Gotanda | 340/518 |
| 4,568,909 | 2/1986 | Whynacht | 187/133 |
| 4,622,538 | 11/1986 | Whynacht et al. | 340/506 |
| 4,703,325 | 10/1987 | Chamberlin et al. | 340/506 |

*Primary Examiner*—A. D. Pellinen

*Assistant Examiner*—Lawrence E. Colbert

*Attorney, Agent, or Firm*—Leydig, Voit & Mayer

[57] ABSTRACT

An elevator monitor apparatus comprises an elevator control device for controlling the driving of an elevator, an individual control device for controlling the status of elevators building by building, a central monitor device for centrally monitoring the status of the elevator in a plurality of buildings. There is also provided a job start signal generation device for generating a job starting signal when an elevator maintenance and check-up job is started, a job completion signal generation device for generating a job completion signal when an elevator maintenance and check-up job is finished, and a communication control device for communicating with the elevator control device according to an instruction from the individual control device and for outputting an abnormality signal to the central monitor device when a job completion signal from the job completion signal generation device is not detected before a predetermined time has elapsed.

4 Claims, 3 Drawing Sheets

ELEVATOR MONITOR APPARATUS

BACKGROUND OF THE INVENTION

1. Field of the Invention

The present invention relates to an elevator monitor apparatus and, in particular, to an elevator monitor apparatus which is capable of monitoring an elevator during elevator maintenance and check-up job.

2. Description of the Related Art

FIG. 3 is a block diagram illustrating the conventional elevator monitor apparatus disclosed in Japanese Patent Laid Open No. 63-258382.

Shown in the figure are an elevator control circuit 1 for controlling the driving of an elevator, a CPU 2 which functions as a central processing unit for the elevator control circuit 1, a memory 3 for storing various kinds of information, an elevator interface 4 for connecting with an elevator, an elevator 5, and a communication interface 6. Shown also in the figure are a monitor apparatus 7 in a remote monitor center, a communication interface 8, a computer 9 of the monitor apparatus 7, a keyboard 10 for accepting command inputs, a CRT 11 for various displays, and a telephone line 12 which connects the elevator control circuit 1 and the monitor apparatus 7.

A conventional elevator monitor apparatus is constructed as described above. The elevator control circuit 1 and the monitor apparatus 7 send and receive data to and from each other via the communication interfaces 6 and 8, and the telephone line 12.

Next, the operation of this elevator monitor apparatus will be explained.

First, a maintenance command input from the keyboard 10 is output from the monitor apparatus 7 via the communication interface 8. This output data is received by the elevator control circuit 1 through the telephone line 12 and the communication interface 6. The CPU 2 performs various kinds of calculations in accordance with this received maintenance command, updates the contents of the memory 3 and properly controls the driving of the elevator 5. In this way, the monitor apparatus 7 and the elevator control circuit 1 are connected with the telephone line 12 and data is sent and received between them.

However, the number of elevators installed has increased considerably in recent years and a great deal of labor is required for the maintenance and check-up job of elevators. A maintenance and check-up job performed by one worker has increased accordingly. This maintenance and check-up job is often risky, and therefore safety management regarding workers has been an important concern in the past.

In such circumstances, in a conventional elevator monitor apparatus as described above, in spite of the data transmission functions between the elevator control circuit 1 and the monitor apparatus 7, neither data transmission function is utilized to improve safety management regarding workers.

SUMMARY OF THE INVENTION

It is an object Of the present invention to provide an elevator monitor apparatus which aids in the safety management of the worker in which the data transmission functions of an elevator control mechanism and a monitor mechanism during the performance of maintenance and check-up job on elevators are effectively utilized.

An elevator monitor apparatus of the present invention comprises an elevator control means for controlling the driving of an elevator, an individual control means for controlling the status of an elevator building by building, a central monitor means for centrally monitoring the statuses of elevators in a plurality of buildings, a job start signal generation means for generating a job start signal at the start time of elevator maintenance and check-up job on an elevator, a job completion signal generation means for generating a job completion signal when an elevator maintenance and check-up job is finished, and a communication control means for communicating with the elevator control means according to an instruction from the individual control means and for outputting an abnormality signal to the central monitor means when a job completion signal from the job completion signal generation means is not detected even when a predetermined time has elapsed after the job start signal from the job start signal generation means is detected during elevator maintenance and check-up job.

These and other objects, features and advantages of the present invention will become clear when reference is made to the following description of the preferred embodiments of the present invention, together with reference to the accompanying drawings.

DESCRIPTION OF THE PREFERRED EMBODIMENTS

An embodiment of the present invention will be explained with reference to the accompanying drawings.

Figure 1:
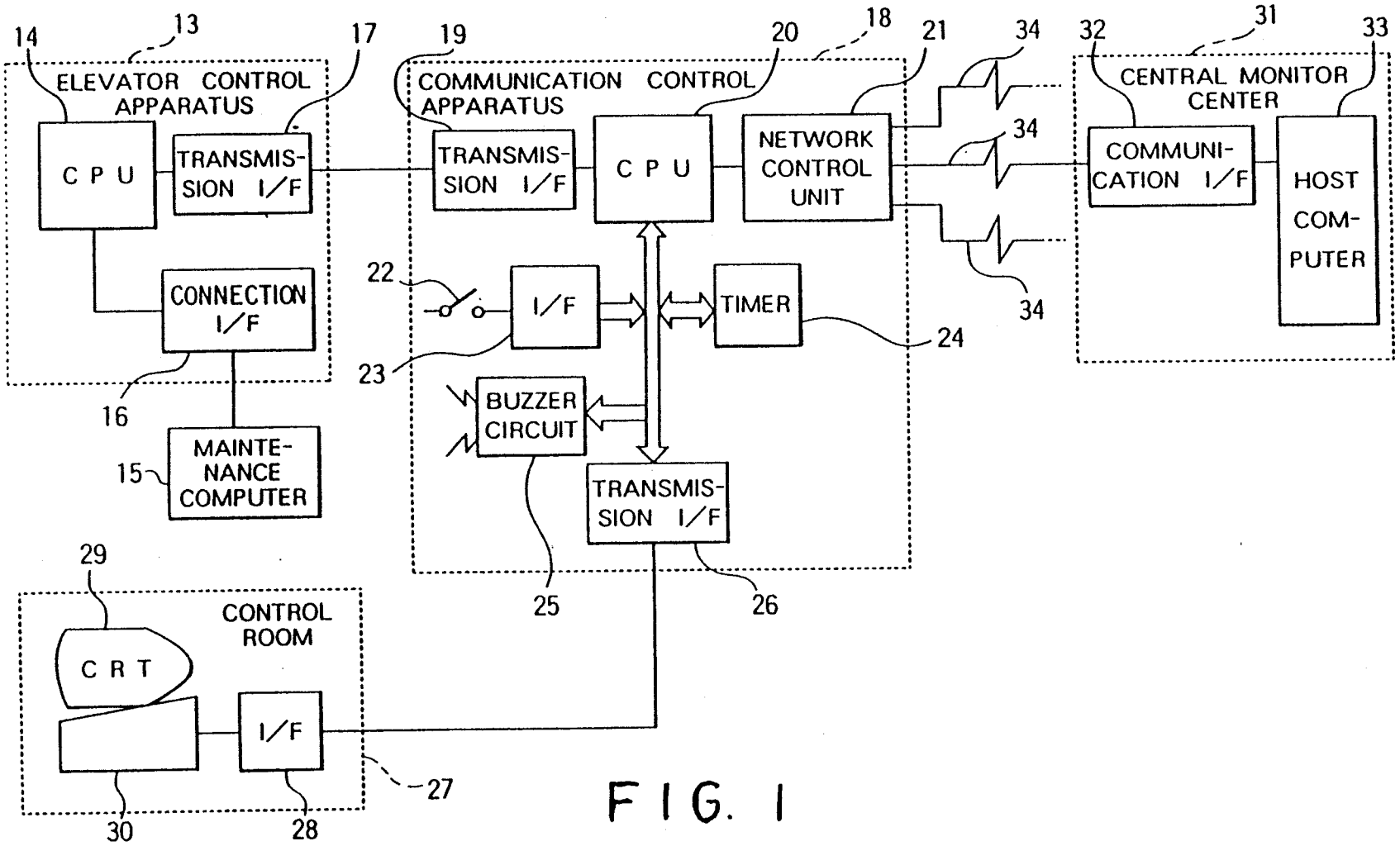
FIG. 1 is a block diagram illustrating an elevator monitor apparatus in one embodiment of the present invention.

In FIG. 1, an elevator control apparatus 13 is used to control the driving of an elevator and has a CPU 14 and a data transmission interface 17. A maintenance computer 15 for use at maintenance and check-up time is connected to the CPU 14 via a connection interface 16, whereas a CPU 20 is connected to the transmission interface 17 via the transmission interface 19 of a communication control apparatus 18. Connected to the CPU 20 are a network control unit 21 for interfacing between various kinds of apparatus, a timer 24 for measuring time, a buzzer circuit 25 for sounding an alarm, a data transmission interface 26, and a manual switch 22 via an interface 23.

In a control room 27 are disposed a CRT 29 for displaying various kinds of information and functioning as a monitor display apparatus and a control unit 30 for the CRT 29 which can be operated by the manager, both of which are connected to the transmission interface 26 of the communication control apparatus 18 via an interface 28. A control room 27 is installed in every building, constituting an individual control means where the interface 28, the CRT 29 and the control unit 30 are integrated and which controls the status of the elevators building by building.

The communication interface 32 of a central monitor center 31 is connected to the network control unit 21 of the communication control apparatus 18 via a telephone line 34. A host computer 33 is connected to this interface 32. The central monitor center 31 is positioned at a place remote from the building where an elevator is installed and functions as a central monitor means which centrally monitors the status of the elevators of each building.

Data communication is performed via the telephone line 34 between the central monitor center 31 and the communication control apparatus 18, and between the elevator control apparatus 13 and the communication control apparatus 18.

Figure 2:
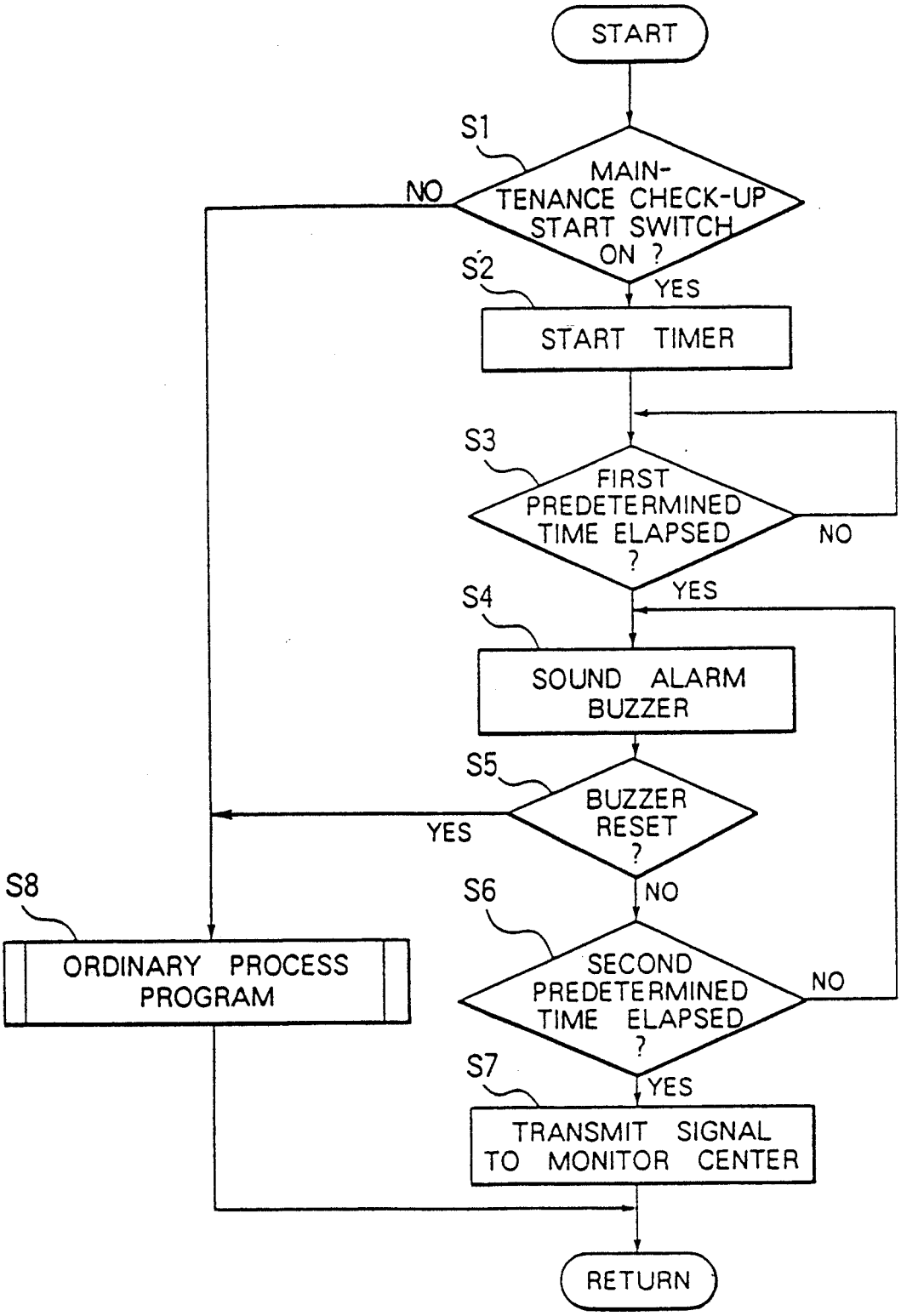
FIG. 2 is a flowchart illustrating the operation of the embodiment.
Figure 3:
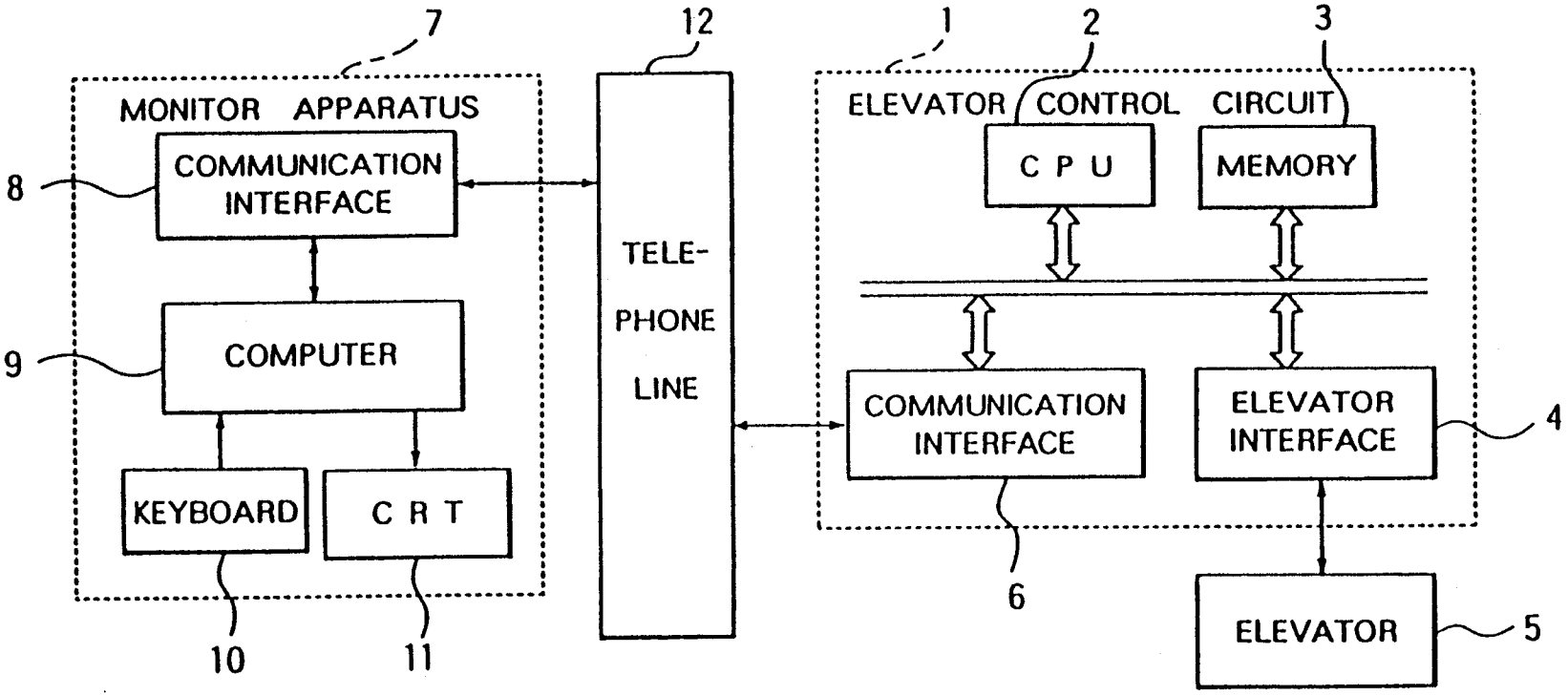
FIG. 3 (PRIOR ART)
FIG. 3 is a block diagram illustrating a conventional elevator monitor apparatus.

Next, the operation of this embodiment during maintenance and check-up job will be explained with reference to the flowchart of FIG. 2. This flowchart shows the procedure of the CPU 20 in the communication control apparatus 18 after maintenance and check-up job is started.

First, when starting a maintenance and check-up job, the worker turns on the switch 22 of the communication control apparatus 18. A switching signal from this switch 22 is detected by the CPU 20 via the interface 23. This signal is handled as the starting signal for the maintenance and check-up job. In step S1, it is judged whether or not this switch 22 is turned on. Where the switch 22 has not been turned on, it is judged that the maintenance and checkup job has not yet started and the operation of steps S2 to S7 are not performed. Where it is confirmed that the switch 22 has been turned on in step S1, the timer 24 is activated in step S2. This timer 24 measures the time that has elapsed since the job start signal was detected. In step S3, it is judged whether or not a first predetermined time has elapsed since the start of the operation of the timer 24. As regards this judgment operation of whether or not the first predetermined time has elapsed, a time-setting interrupt in which job steps and so forth are taken into account may be applied. As a result, time corresponding to the contents of a maintenance and check-up job can be set as the first predetermined time. When the first predetermined time has elapsed in step S3, the buzzer circuit 25 is activated to sound an alarm buzzer as a signal that job time is finished in step S4. The worker who hears this alarm sound switches the switch 22 from on to off, meaning that the job has been completed even if he is at job. It is judged that a job completion action has been performed by the fact that the off signal from this switch 22 is detected by the CPU 20. Also, the resetting of the alarm buzzer is performed by switching the switch 22 from on to off. In step S5, it is judged whether or not the alarm buzzer has been reset. Where it has not been reset, namely, where the job completion action has not been performed, it is judged in step S6 whether or not a second predetermined time has elapsed since the alarm buzzer has sounded. Where the alarm buzzer has been reset within this second predetermined time, the process proceeds, from step S5 to step S8 where a normal processing program is executed. That is, it is judged that the maintenance and check-up job on the elevator has been terminated normally and the process proceeds to the normal monitor routine. Where the second predetermined time has elapsed since the alarm buzzer sounded in step S6, since this is a case where the alarm buzzer has not been reset, it is judged that an abnormal situation due to some accident to the worker has occurred and in step S7 an abnormality signal is transmitted to the central monitor center 31 from the network control unit 21. The central monitor center 31 receives this abnormality signal via the telephone line 34 and the communication interface 32 and the required processing is performed by the host computer 33. When this abnormality signal is received, the personnel of the central monitor center 31 immediately get in touch with the field site to confirm the safety of the workers and perform the proper actions. Contact at this juncture includes a call over the telephone line or the dispatch of another worker to the scene.

As described above, in the elevator monitor apparatus of this embodiment, a job start signal is detected by the communication control apparatus 18 during elevator maintenance and check-up job. When the first predetermined time has elapsed after the job start signal is detected, the worker is prompted to perform a job termination process by an alarm buzzer. After this, when a job completion signal is not detected by the resetting of the alarm buzzer. When the second predetermined time has elapsed, it is judged that an abnormality has occurred and an abnormality signal is transmitted to the central monitor center 31 via a telephone line.

Therefore, the data transmission function of the elevator control mechanism and monitor mechanism during the elevator maintenance and check-up job is effectively utilized with the result that an elevator abnormal operation can be confirmed even at a remote place like a central monitor center or the like. Thus, the safety management of the worker can be effected properly even during a single maintenance and check-up job by one worker.

When an alarm buzzer sounds during job, because the worker is safe, he switches the switch 22 once from on to off. However, since the job must be continued, the switch 22 is again turned on so that the job may be continued.

Meantime, in the above-mentioned embodiment, as a job start signal from a maintenance and check-up job, a job start signal is generated by turning on the switch 22 of the communication control apparatus 18. However, it may be arranged that the maintenance computer 15 for use at maintenance and check-up job time is connected to the connection interface 16 and the CPU 14 of the elevator control apparatus 13 and made to output a job start signal to the communication control apparatus 18 via the transmission interface 17.

In the above-mentioned embodiment, when the alarm buzzer is not reset, even if a second predetermined time has elapsed, an abnormality signal is transmitted to the central monitor center 31. At the same time, it may be arranged that this abnormality signal is also output to the control room 27 which functions as an individual control means via the transmission interfaces 26 and 28, and is displayed on the CRT 29. Such arrangement enables highly reliable safety management and a speedy response by a manager of a building in the event an abnormality occurs.

In addition, in the above-mentioned embodiment, a timer function is incorporated in the communication control apparatus 18. However, this timer function may be incorporated in the central monitor center 31. In this case, however, it is necessary to output a signal indicating that a job start signal is detected to the central monitor center 31 on detection of the signal and to measure time by the central monitor center 31. Such arrangement enables the job performed by the communication control apparatus 18 to be reduced.

In the above-mentioned embodiment, it is presupposed that there is an individual control means that controls the statuses of elevators building by building. The present invention, however, can be used in the case where no individual control means is provided.

Many widely different embodiments of the present invention can be made without departing from the spirit and scope thereof, therefore it is to be understood that this invention is not limited to the specific embodiments thereof except as defined in the appended claims.

What is claimed is:

1. An elevator monitor apparatus, comprising:

elevator control means for controlling the driving of an elevator;

individual control means for controlling the status of elevators building by building;

central monitor means for centrally monitoring the status of the elevators in a plurality of buildings;

job start signal generation means for generating a job starting signal when an elevator maintenance and check-up job is started;

job completion signal generation means for generating a job completion signal when a elevator maintenance and check-up job is finished;

communication control means for communicating with said elevator control means according to an instruction from said individual control means, said communication control means sounding an alarm after a first predetermined time period has elapsed following detection of a job starting signal from said job start signal generating means, said communication control means outputting an abnormality signal to said central monitor means when a job completion signal from said job completion signal generation means is not detected after a second predetermined time period has elapsed following the sounding of the alarm.

2. An apparatus according to claim 1, wherein said communication control means outputs said abnormality signal to said central monitor means via a telephone line.

3. An apparatus according to claim 1, wherein said job start signal generation means includes a manual switch.

4. An apparatus according to claim 3, wherein said job completion signal generation means shares said switch.

* * * * *